US011547232B2

(12) United States Patent
Otabil

(10) Patent No.: US 11,547,232 B2
(45) Date of Patent: Jan. 10, 2023

(54) SHOE ORGANIZER

(71) Applicant: Ernest Otabil, Brampton (CA)

(72) Inventor: Ernest Otabil, Brampton (CA)

( * ) Notice: Subject to any disclaimer, the term of this patent is extended or adjusted under 35 U.S.C. 154(b) by 208 days.

(21) Appl. No.: 16/716,748

(22) Filed: Dec. 17, 2019

(65) Prior Publication Data

US 2021/0177180 A1 Jun. 17, 2021

(51) Int. Cl.
*A47G 25/00* (2006.01)
*A47F 7/08* (2006.01)
*A47F 5/08* (2006.01)

(52) U.S. Cl.
CPC ..... *A47G 25/005* (2013.01); *A47F 5/08* (2013.01); *A47F 7/08* (2013.01)

(58) Field of Classification Search
CPC ..... A47G 25/005; A47G 25/10; A47F 7/08; A47F 5/08; A47F 7/06; A47F 5/0823; A47B 61/04; A43D 117/00; B65D 85/187; A47L 23/20
USPC ..... 211/34–36
See application file for complete search history.

(56) References Cited

U.S. PATENT DOCUMENTS 332,238 A * 12/1885 Denton ..... A47B 17/03 312/229
736,003 A * 8/1903 Orrick ..... A47B 61/00 312/213
764,343 A * 7/1904 Bowen ..... A47F 7/08 211/34
1,404,270 A * 1/1922 Carr ..... A47F 7/08 211/34
2,069,635 A * 2/1937 Whenham ..... A47B 61/04 211/35
2,195,919 A * 4/1940 Crilly ..... A47F 7/08 211/35
2,536,059 A * 1/1951 Igler ..... A47B 61/02 211/90.04
2,866,559 A * 12/1958 Byrne ..... A47G 25/005 211/35

(Continued)

FOREIGN PATENT DOCUMENTS

WO WO-2012036631 A * 3/2012 ..... A47B 61/04

*Primary Examiner* — Devin K Barnett
(74) *Attorney, Agent, or Firm* — Orin Del Vecchio

(57) ABSTRACT

The present invention relates to a wall-mounted vertically oriented shoe organizer, the shoe organizer formed from: a backboard, the backboard having a planar shape and the backboard being mounted to the wall and extending in a plane parallel to the wall; a frame, the frame covering the perimeter of the backboard and extended outward therefrom in a direction perpendicular to the plane of the backboard; a plurality of cylinders secured to the backboard, each cylinder extending in a direction perpendicular to the plane of the blackboard and each cylinder defining a recess therein suitable of insertion of a shoe heel; and one or more ledges secured to the backboard, each ledge extending perpendicular from the plane of the backboard and oriented such that each ledge is parallel to the ground when the backboard is mounted to the wall, wherein the shoe organizer stores one or more pairs of shoes, with each shoe in each pair of shoes being supported on the shoe organizer via one of: inserting the shoe heel of the each shoe into one of the cylinders and resting the shoe heel of the each shoe along one of the ledges.

7 Claims, 9 Drawing Sheets

(56) References Cited

U.S. PATENT DOCUMENTS 3,661,435 A * 5/1972 Miller ..... A47B 67/00 312/321
4,611,717 A * 9/1986 Hutson ..... A47F 3/005 211/34
4,697,713 A 10/1987 Pryor
4,736,996 A * 4/1988 Zeichner ..... A47B 61/04 312/118
D317,835 S * 7/1991 Staton ..... D6/672
D320,515 S * 10/1991 Staton ..... D6/681.1
5,118,176 A * 6/1992 Motley, Sr. ..... A47F 7/08 160/237
5,163,745 A * 11/1992 Zagata ..... A47B 96/00 312/223.5
5,170,892 A * 12/1992 Fromkin ..... A47B 47/00 211/184
5,337,905 A * 8/1994 Gast ..... A47B 61/00 211/105.3
5,582,306 A * 12/1996 Balter ..... A47B 61/00 211/105.1
6,098,815 A 8/2000 Nesser
6,755,493 B1 * 6/2004 Krietzman ..... H02B 1/44 16/265
6,808,152 B2 * 10/2004 Fell ..... A47F 5/0815 248/441.1
6,948,622 B2 * 9/2005 Brownfield ..... A47F 7/08 211/36
7,025,214 B2 4/2006 Klein et al.
8,967,742 B1 3/2015 Huewitt, Jr.
9,675,187 B2 6/2017 Pizano
11,071,379 B1 * 7/2021 Clontz ..... A47B 61/04
2003/0090178 A1 * 5/2003 Cattoire ..... A47B 61/00 312/205
2003/0111434 A1 * 6/2003 Stoddart ..... A47B 43/00 211/118
2005/0074187 A1 * 4/2005 Sabounjian ..... A47B 43/003 383/38
2005/0252869 A1 * 11/2005 Graham ..... A47F 7/08 211/36
2006/0076859 A1 * 4/2006 Slappey ..... A47B 61/00 312/311
2007/0138113 A1 * 6/2007 Haberman ..... A47B 96/06 211/35
2009/0200903 A1 * 8/2009 Tassin ..... E06B 7/34 312/326
2009/0206711 A1 * 8/2009 Glenn ..... A47B 43/003 312/108
2009/0223915 A1 * 9/2009 Thompson ..... A47B 49/004 211/85.3
2012/0001526 A1 * 1/2012 Simondi ..... A47F 7/08 312/234.1
2012/0098396 A1 * 4/2012 Schinzing ..... A47B 57/00 312/245
2014/0263888 A1 9/2014 Robelli
2016/0095430 A1 * 4/2016 Moyer ..... A47B 47/0091 312/265.4
2017/0295928 A1 * 10/2017 Allen ..... A47B 61/04
2018/0213931 A1 * 8/2018 Schoewe ..... A47B 95/008
2018/0279776 A1 * 10/2018 Davis ..... A47B 61/04
2021/0405867 A1 * 12/2021 Yoo ..... G06F 3/04886

* cited by examiner

SHOE ORGANIZER

FIELD OF THE INVENTION

The present specification relates generally to a shoe organizer, and more particularly to a wall-mounted vertically oriented shoe organizer.

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

Shoe organizers are a common display item in both commercial and home environments. Shoe organizers perform both a functional and aesthetic purpose by providing a space to both organize shoes according to a desired feature (size, color, style, etc.) while also displaying the shoes in a visually appealing manner for selection. As individual shoe collections have become both larger and more common, a demand has been created for more functional and visually appealing show organizers than those commonly found in commercial use.

However, existing models of shoe organizers generally require a great deal of space to store and display shoes. Often, to reduce space, shoe organizers are provided as collapsible or foldable bins or drawers, however, these solutions then result in the shoes been poorly visible or not visible at all, which aggravates the problem of finding the desired pair of shoes. Other solutions rely on custom-built racks or shelves, which are generally very expensive and require a permanent modification to the storage space, and such medication are not always possible (e.g. rental housing).

Thus, while there are some shoe organizers known in the art, it would be desirable to have a shoe organizer which partially or completely mitigates some of the disadvantages discussed above.

Accordingly, there remains a need for improvements in the art.

SUMMARY OF THE INVENTION

In accordance with an aspect of the invention, there is provided a wall-mounted vertically oriented shoe organizer.

According to an embodiment of the invention, there is provided a wall-mounted vertically oriented shoe organizer, comprising: a backboard, the backboard having a planar shape and the backboard being mounted to the wall and extending in a plane parallel to the wall; a frame, the frame covering the perimeter of the backboard and extended outward therefrom in a direction perpendicular to the plane of the backboard; a plurality of cylinders secured to the backboard, each cylinder extending in a direction perpendicular to the plane of the blackboard and each cylinder defining a recess therein suitable of insertion of a shoe heel; and one or more ledges secured to the backboard, each ledge extending perpendicular from the plane of the backboard and oriented such that each ledge is parallel to the ground when the backboard is mounted to the wall, wherein the shoe organizer stores one or more pairs of shoes, with each shoe in each pair of shoes being supported on the shoe organizer via one of: inserting the shoe heel of the each shoe into one of the cylinders and resting the shoe heel of the each shoe along one of the ledges.

Optionally, the shoe organizer may further comprise a cylinder mount secured to the backboard, the cylinder mount comprising multiple slots, wherein each slot is dimensioned to receive one of each cylinder. The cylinders may be removable, and the backboard may be detachable secured to the wall (e.g. via hooks, magnets, etc.).

According to a further embodiment of the invention, there is provided a kit for a shoe organizer, comprising: a backboard, the backboard having a planar shape and the backboard being mountable to the wall and extending in a plane parallel to the wall when mounted; a frame, the frame securable to and covering the perimeter of the backboard and extended outward therefrom in a direction perpendicular to the plane of the backboard; a plurality of cylinders securable to the backboard, each cylinder extending in a direction perpendicular to the plane of the blackboard and each cylinder defining a recess therein suitable of insertion of a shoe heel; and one or more ledges securable to the backboard, each ledge extending perpendicular from the plane of the backboard and oriented such that each ledge is parallel to the ground when the backboard is mounted to the wall, wherein the shoe organizer stores one or more pairs of shoes, with each shoe in each pair of shoes being supported on the shoe organizer via one of: inserting the shoe heel of the each shoe into one of the cylinders and resting the shoe heel of the each shoe along one of the ledges.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

Other aspects and features according to the present application will become apparent to those ordinarily skilled in the art upon review of the following description of embodiments of the invention in conjunction with the accompanying figures.

BRIEF DESCRIPTION OF THE DRAWINGS

Reference will now be made to the accompanying drawings which show, by way of example only, embodiments of the invention, and how they may be carried into effect, and in which.

Like reference numerals indicated like or corresponding elements in the drawings.

DETAILED DESCRIPTION OF THE EMBODIMENTS

The present invention relates to a shoe organizer and, in particular, a wall-mounted vertically oriented shoe organizer.

Figure 1:
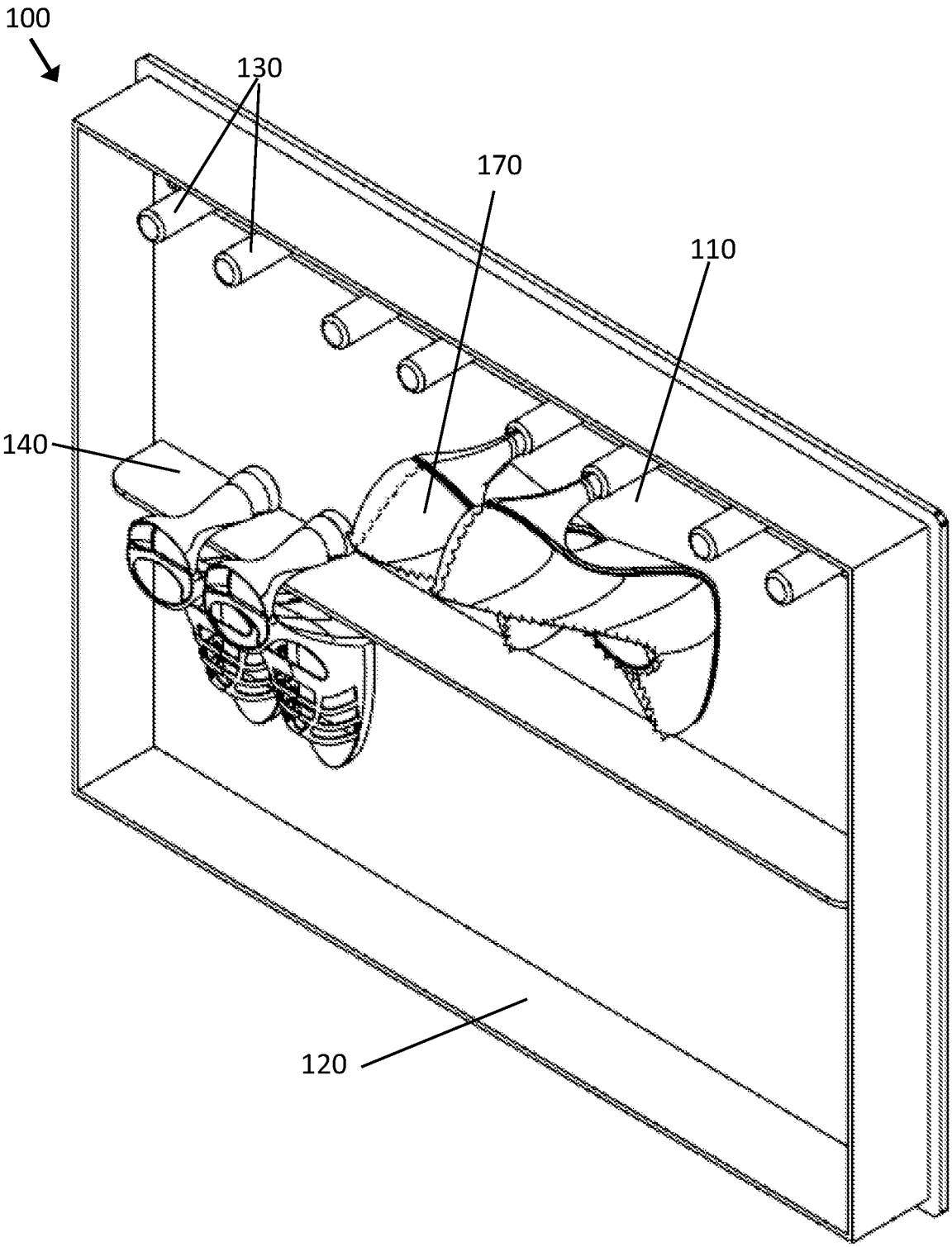
FIG. 1 is a front perspective view of a show organizer according to an embodiment.

According to an embodiment as shown in FIG. 1 a shoe organizer 100 is comprised of a backboard 110 surrounded by frame 120 around the perimeter of the backboard 110. Secured to the backboard 110 are a plurality of cylinders 130, the cylinders 130 arranged in one or more pairs proximate to the top edge of backboard 110. As shown in FIG. 1, the cylinders 130 may be arranged along the same plane, however, the cylinders 130 may be positioned on alternate planes, or otherwise staggered, either individually or in pairs, to accommodate both functional and aesthetic variations. Shoes 170 are then organized and stored via the cylinder 130.

Figure 2A:
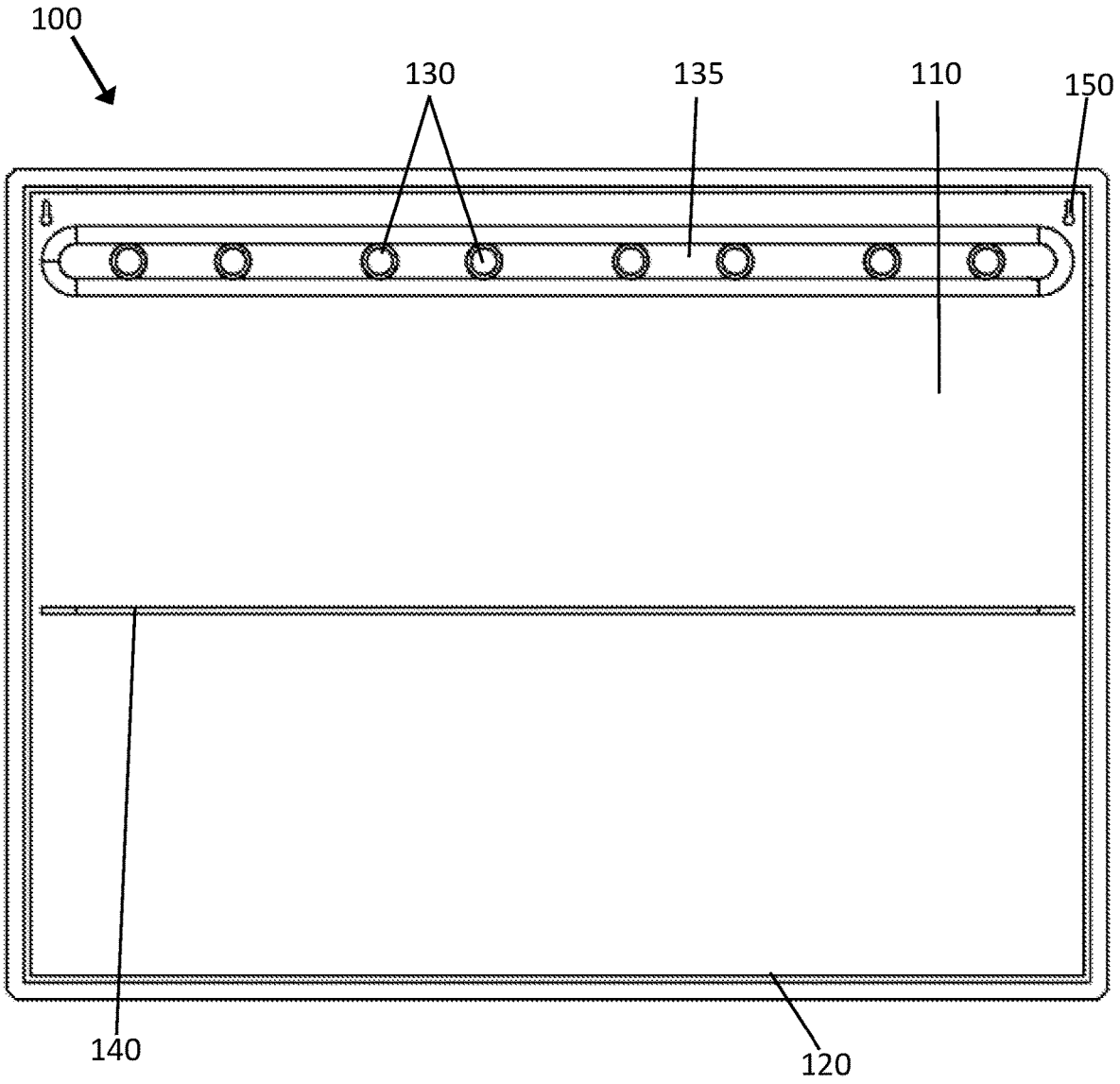
FIG. 2A is a front view of the shoe organizer of FIG. 1.
Figure 3A:
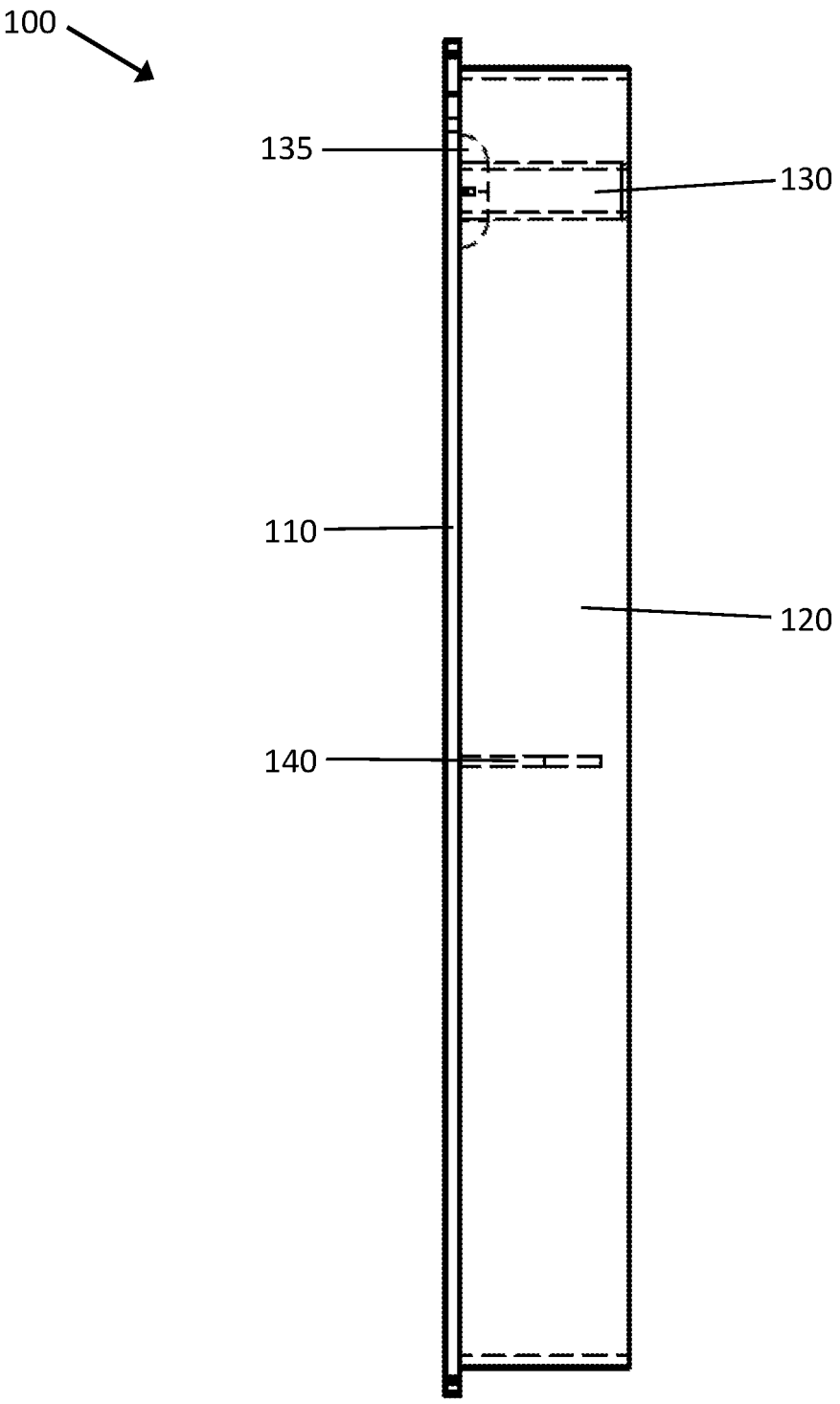
FIG. 3A is a transparent side view of the shoe organizer of FIG. 1.
Figure 4A:
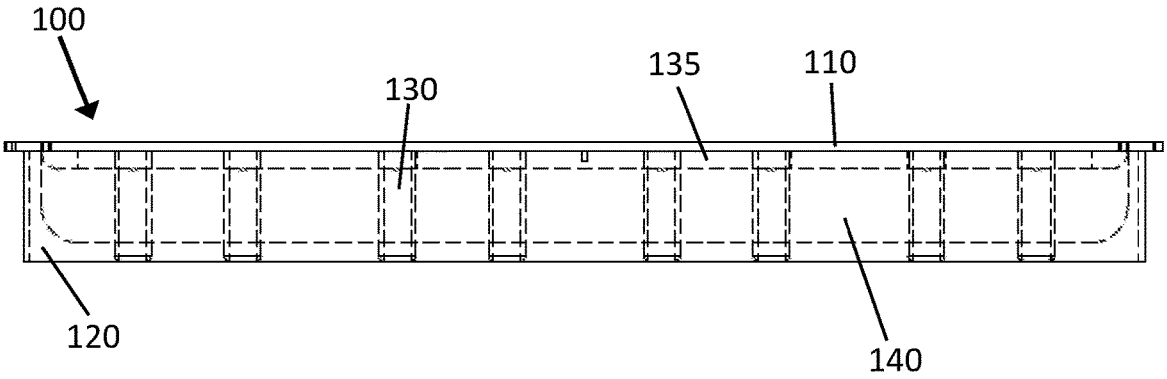
FIG. 4A is a transparent top view of the shoe organizer of FIG. 1.

Referring to FIGS. 2A, 3A and 4A, a cylinder mount 135 is secured to the backboard 110. The cylinders 130 thus pass through slots in the cylinder mount 135 prior to being secured to the backboard. The use of the cylinder mount 135 assists in reducing any movement or deformation of the cylinders 130 over time.

A ledge 140 is positioned proximate to the vertical midpoint of the backboard 110 and runs parallel to the top and bottom edges of the backboard 110 as shown. The ledge 140 extends across the majority of the width of backboard 110. Dimensionally, the frame 120 extends from one to three inches and acts to protects shoes 170 mounted on the shoe organizer 100 from being damaged or dislodged through inadvertent contact. The cylinders 130 similarly range in height from one to three inches in order to accommodate different heel heights on the shoes 170. All of the cylinders 130 may be the same height, or they may vary, although both cylinders in a pair should be of the same height. Additionally, cylinders 130 may be removeable and replaceable to allow for different cylinders 130 to be mounted on backboard 110 according to the type of shoes being organized.

Figure 2B:
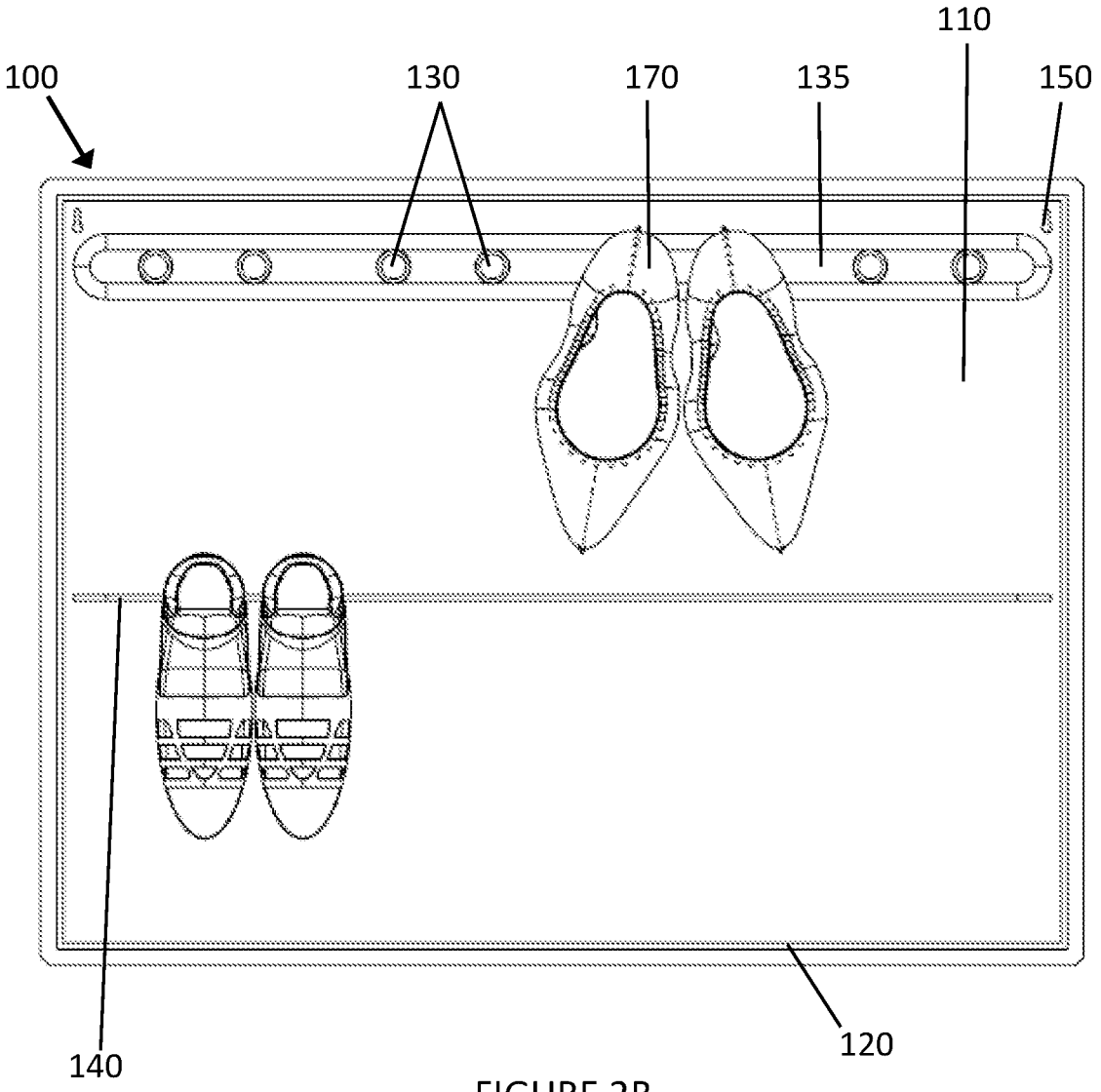
FIG. 2B is a front view of the shoe organizer of FIG. 1, including shoes.
Figure 3B:
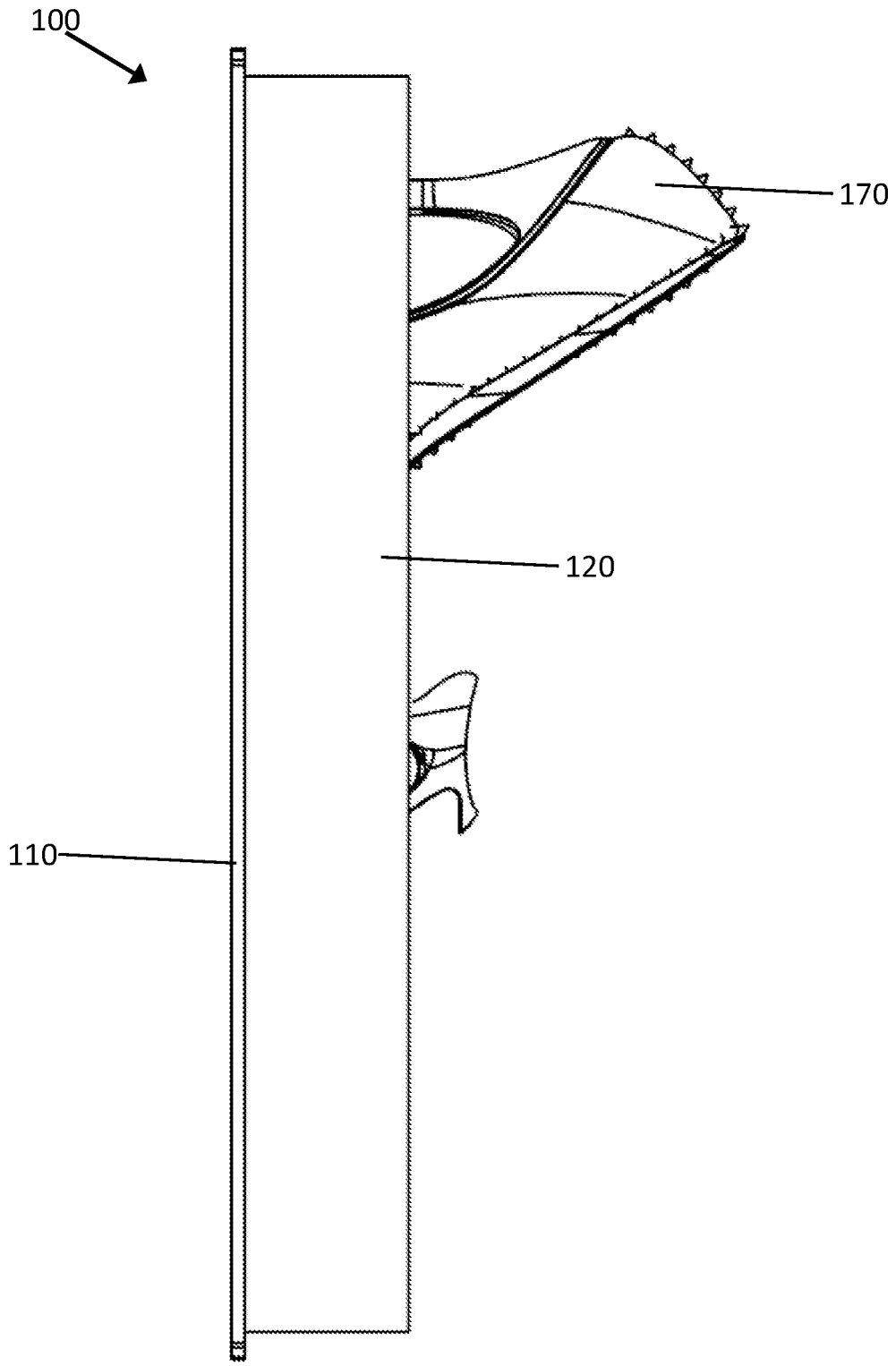
FIG. 3B is a side view of the shoe organizer of FIG. 1, including shoes.
Figure 4B:
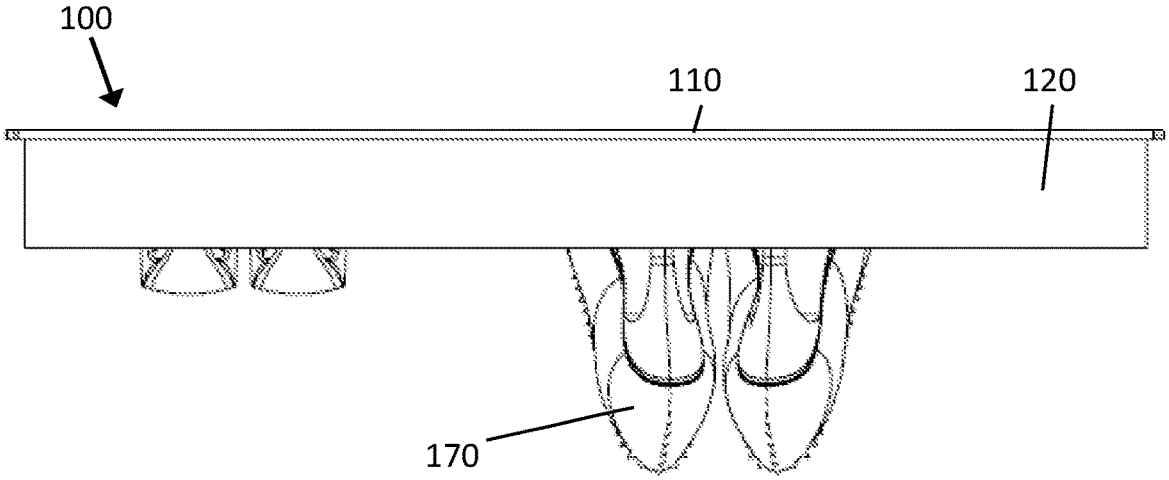
FIG. 4B is a top view of the shoe organizer of FIG. 1, including shoes.

The ledge 140 similarly has a height of one-half to one-and-one-half inches such the heel of a shoe mounted on ledge 140 rests on backboard 110. FIGS. 2B, 3B and 4B illustrate the organizing and storage of shoes 170 on the shoe organizer 100.

Operationally, the shoe organizer 100 is secured to a wall, either directly using fasteners such as screws or nails, or indirectly by hanging from a hook or equivalent which is in turn secured to the wall. For example, backboard 110 may be provided with one or more keyhole slots 150 or similar slots which would permit the shoe organizer to be mounted directly via a fastener secured through the slot 150, or indirectly by hanging shoe organizer 100 from a wall-mounted hook that fits through slot 150.

In order to store and organize shoes, once the shoe organizer 100 is mounted on the wall, the individual shoes may then be mounted on the shoe organizer 100 using either cylinders 130 or ledge 140 as appropriate for the shoe type and heel design and height. For a high-heel shoe type, such as a women's stiletto heel, the heel of the shoe 170 is inserted into the cylinder which is of a height such that the bottom of the heel rests on the bottom of the cylinder 130 within the cylinder mount 135 and the sole of the shoe 170 rests on the backboard 110. For a flat-heel shoe type, such as a men's dress shoe, the heel is placed over the ledge such that the heel of the shoe rests on the backboard, with the edge of the ledge aligned at least halfway up the heel and the sole of the shoe resting on the backboard. Once mounted, the shoes are held in place through a combination of support from the cylinder 130 or ledge 140 with friction and gravitational effects. Thus, shoes are stored in a functional and aesthetic manner, and are protected from inadvertent contact and damage by frame 120. Additionally, both the soles of the shoes and the wall are prevented from mutual damage by backboard 110.

Figure 5:
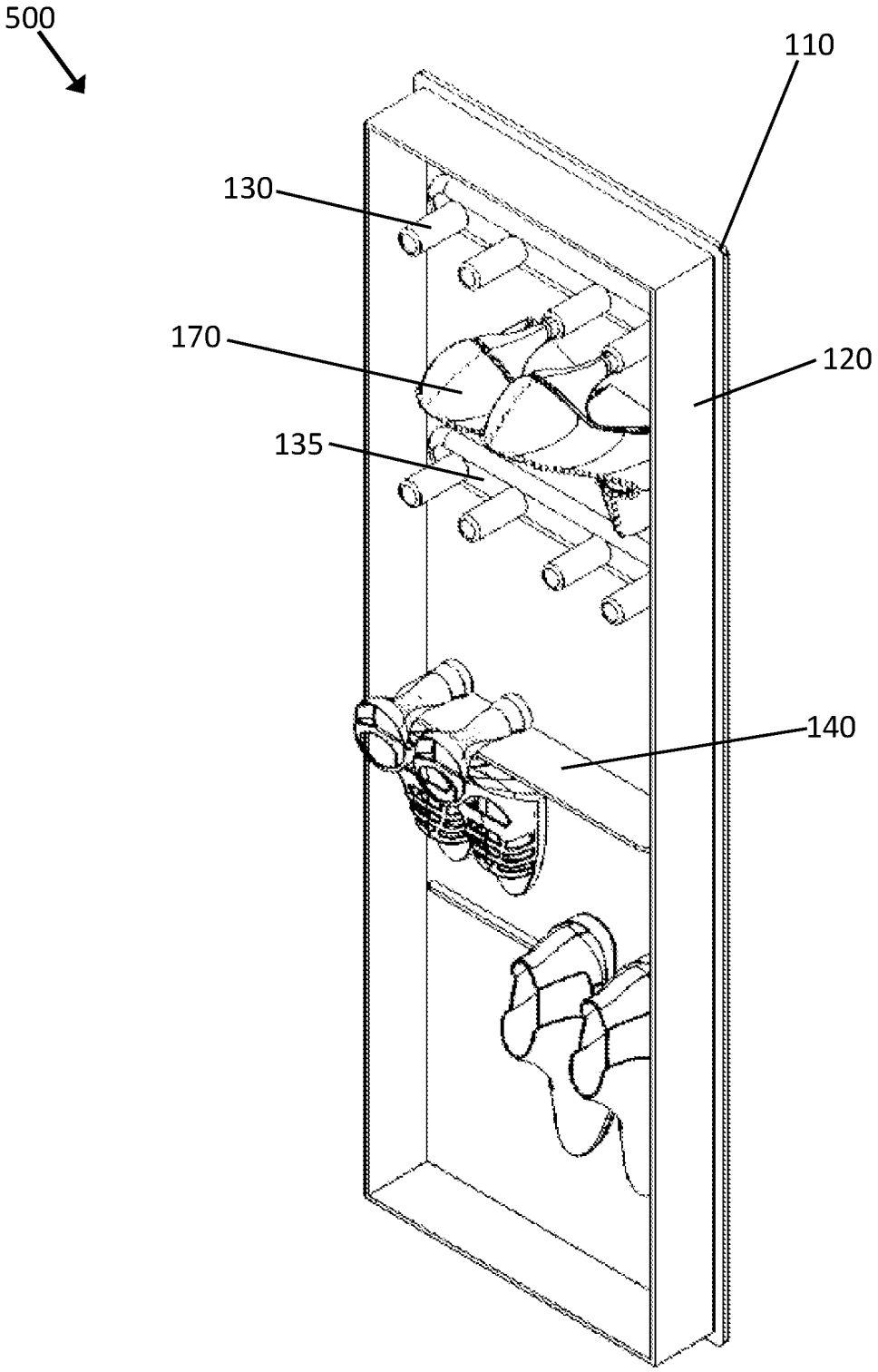
FIG. 5 is a front perspective view of a shoe organizer according to another embodiment.
Figure 6:
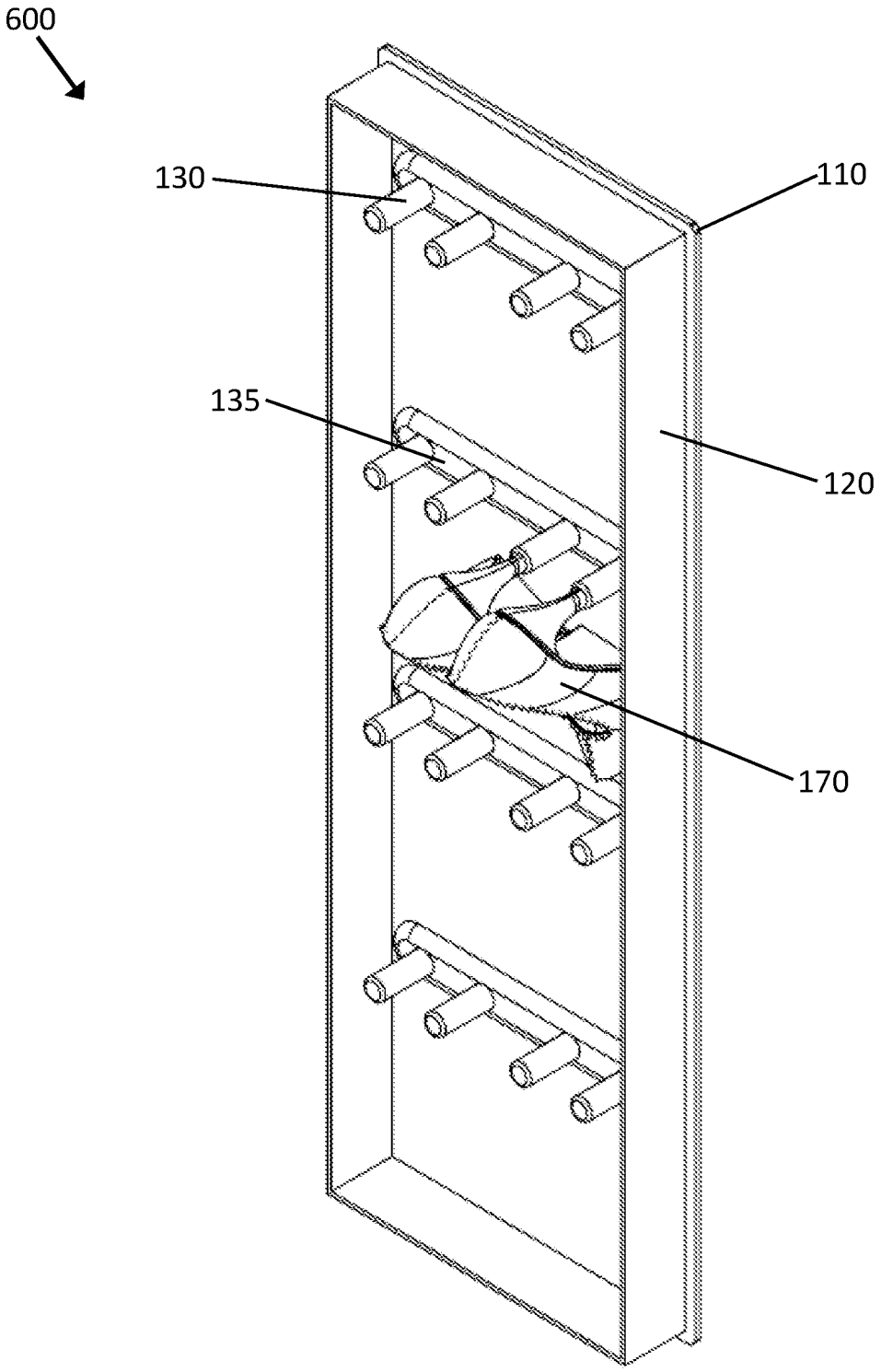
FIG. 6 is a front perspective view of a shoe organizer according to another embodiment.
Figure 7:
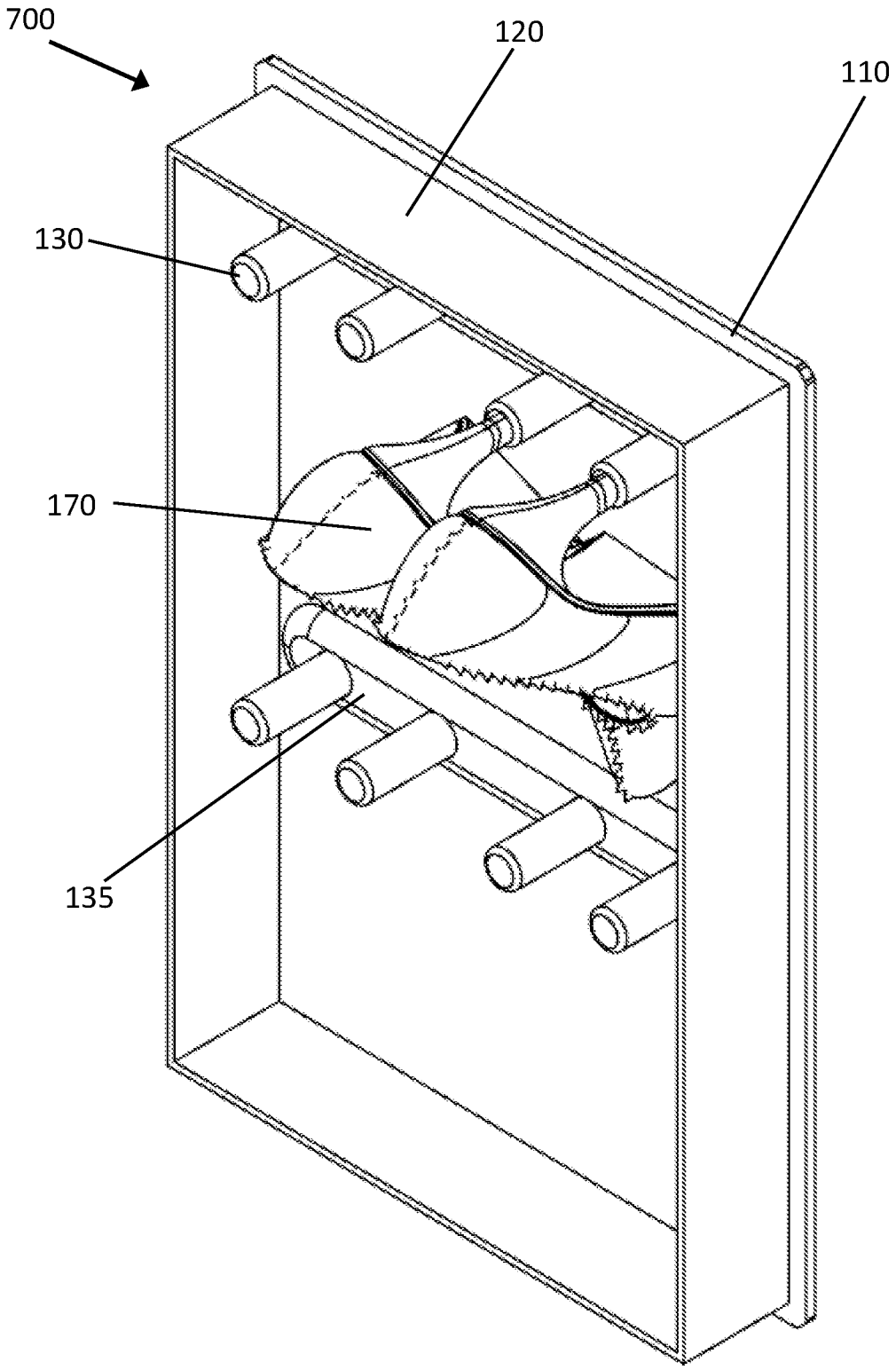
FIG. 7 is a front perspective view of a shoe organizer according to another embodiment.

An alternative embodiment of shoe organizer 500 is shown in FIG. 5. In this embodiment, the shoe organizer 500 is extended vertically to provide for additional rows of shoe storage. Cylinders 130 are laid out in two separate rows, with sufficient vertical separation to allow for shoes to be mounted. Ledge 140 is then located below the rows of cylinders 130. Additional ledges 140 may be located on the organizer as well to provide addition rows of storage, again accounting for necessary space for the shoes. Other embodiments of a shoe organizer 600 and 700 are shown in FIGS. 6 and 7, with multiple rows of cylinders 130 being provided. Further embodiments with different and multiple combinations of cylinders 130 and ledges 140 may be contemplated, based on the overall size and dimensions of backboard 110.

As shown, backboard 110 and frame 120 are rectangular in shape. However other shapes may be contemplated (oval, diamond, etc.), as long as sufficient space is provided around the cylinders 130 for shoe storage and ledge 140 remains parallel to the ground when the shoe organizer 100 is secured to the wall.

Similarly, while shoe organizer 100 is described as secured to a wall, any vertical surface may suffice and is considered as equivalent to a wall as the term is used herein. For example, shoe organizer 100 may be secured to the side of a wardrobe, or to a closet door, as long as the surface and/or object is capable of supporting the weight of the shoe organizer when full of stored shoes.

It should also be noted that the steps described in the method of use can be carried out in many different orders according to user preference. The use of "step of" should not be interpreted as "step for", in the claims herein and is not intended to invoke the provisions of 35 U.S.C. § 112(f). It should also be noted that, under appropriate circumstances, considering such issues as design preference, user preferences, marketing preferences, cost, structural requirements, available materials, technological advances, etc., other methods are taught herein.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

The present invention may be embodied in other specific forms without departing from the spirit or essential characteristics thereof. Certain adaptations and modifications of the invention will be obvious to those skilled in the art. Therefore, the presently discussed embodiments are considered to be illustrative and not restrictive, the scope of the invention being indicated by the appended claims rather than the foregoing description and all changes which come within the meaning and range of equivalency of the claims are therefore intended to be embraced therein.

What is claimed is:

1. A wall-mounted vertically oriented shoe organizer, comprising: a rectangular backboard, the backboard having a first length, a first width, and a planar shape, and the backboard being mounted to a wall and extending in a plane parallel to the wall;

a rectangular hollow frame, the frame has a second length and a second width, the first length is larger than the second length and the first width is larger than the second width, the frame is positioned inside and follows a perimeter of the backboard and is extended outward therefrom in a direction perpendicular to the plane of the backboard;

a plurality of cylinders secured to the backboard within the frame, each cylinder extending in a direction perpendicular to the plane of the blackboard and each cylinder defining an open recess that is configured to receive a shoe heel therein; and one or more ledges secured to the backboard, each ledge extending perpendicular from the plane of the backboard and oriented such that each ledge is parallel to a ground surface when the backboard is mounted to the wall, wherein the shoe organizer is configured to hold one or more pairs of shoes, with each shoe in each pair of shoes held in the shoe organizer via one of: one of the cylinders and one of the ledges.

2. The shoe organizer of claim 1, wherein the cylinders are removable and replaceable.

3. The shoe organizer of claim 1, wherein the backboard is removably mounted to the wall.

4. The shoe organizer of claim 1, wherein cylinders are all of equal height.

5. The shoe organizer of claim 1, wherein the cylinders are arranged in multiple rows.

6. The shoe organizer of claim 1, wherein one or more of the backboard, the frame, the cylinders and the ledges are translucent.

7. The shoe organizer of claim 1, further comprising a cylinder mount secured to the backboard, wherein the cylinders are secured to the backboard via the cylinder mount, the cylinder mount comprising multiple slots, wherein each slot receives a corresponding cylinder from said plurality of cylinders therein.

* * * * *